US008690269B2

(12) United States Patent
Röck

(10) Patent No.: US 8,690,269 B2
(45) Date of Patent: Apr. 8, 2014

(54) DEVICE FOR FASTENING A FUNCTIONAL UNIT IN A FURNITURE BODY

(75) Inventor: Siegfried Röck, Höchst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/564,064

(22) Filed: Aug. 1, 2012

(65) Prior Publication Data

US 2012/0291226 A1 Nov. 22, 2012

Related U.S. Application Data

(63) Continuation of application No. PCT/AT2011/000066, filed on Feb. 4, 2011.

(30) Foreign Application Priority Data

Feb. 5, 2010 (AT) ..... A 168/2010

(51) Int. Cl.
*A47B 95/02* (2006.01)

(52) U.S. Cl.
USPC ..... 312/319.7

(58) Field of Classification Search
USPC ..... 312/334.1, 334.5, 330.1, 319.1, 319.5, 312/319.7
See application file for complete search history.

(56) References Cited

U.S. PATENT DOCUMENTS

| | | | | |
|---|---|---|---|---|
| 6,494,550 | B1 * | 12/2002 | Chen et al. | 312/334.5 |
| 7,009,112 | B1 * | 3/2006 | Mead et al. | 174/69 |
| 7,926,891 | B2 | 4/2011 | Ritter | |
| 2009/0127992 | A1 | 5/2009 | Ritter | |
| 2009/0256455 | A1 | 10/2009 | Ho | |
| 2010/0084954 | A1 | 4/2010 | Schneider et al. | |

FOREIGN PATENT DOCUMENTS

| | | |
|---|---|---|
| AT | 504 921 | 9/2008 |
| AT | 010 312 | 1/2009 |
| CN | 101184416 | 5/2008 |
| CN | 101546899 | 9/2009 |
| CN | 101605479 | 12/2009 |
| DE | 73 05 211 | 8/1973 |
| DE | 80 33 332 | 3/1982 |
| DE | 20 2007 006 302 | 4/2008 |
| DE | 20 2007 006 299 | 7/2008 |
| TW | 585042 | 4/2004 |
| WO | 2008/098267 | 8/2008 |
| WO | 2008/101261 | 8/2008 |
| WO | 2008/131968 | 11/2008 |

OTHER PUBLICATIONS

International Search Report issued Jul. 4, 2011 in International (PCT) Application No. PCT/AT2011/000066.

(Continued)

*Primary Examiner* — Matthew Ing
(74) *Attorney, Agent, or Firm* — Wenderoth, Lind & Ponack, L.L.P.

(57) ABSTRACT

A device for fastening a functional unit in a furniture body includes a support and two retaining elements, wherein the functional unit is pre-installed on the support and the two retaining elements are installed on the furniture body, wherein the retaining elements retain the preferably elongated support at the ends, wherein one retaining element is designed as a hinge and wherein the support is pivotably connected to the retaining element installed on the furniture body.

21 Claims, 8 Drawing Sheets

(56) References Cited

OTHER PUBLICATIONS

Austrian Patent Office Search Report completed Nov. 18, 2010 in Austrian Patent Application No. A 168/2010.

Chinese Search Report dated Oct. 14, 2013 in coresponding Chinese Patent Application No. 201180008213.3 (partial English translation).

* cited by examiner

DEVICE FOR FASTENING A FUNCTIONAL UNIT IN A FURNITURE BODY

This application is a Continuation of International Application No. PCT/AT2011/000066, filed Feb. 4, 2011, the entire disclosure of which is incorporated herein by reference.

The invention concerns a device for fastening a functional unit in a furniture carcass, wherein the functional unit is pre-mounted to a carrier and two holding elements are mounted to the furniture carcass, wherein the holding elements hold the—preferably elongate—carrier at the ends.

The invention further concerns an article of furniture comprising such a device. Devices for fastening a functional unit in a furniture carcass are already known. Thus for example AT 504 921 shows a fastening device for fastening an ejector for a movable furniture portion in a furniture carcass, comprising a transverse carrier which can be fastened to the side walls of the furniture carcass by way of two lateral holding portions, the transverse carrier being releasably connected to the holding portions.

The object of the invention is to provide a device for fastening a functional unit in a furniture carcass that is improved over the state of the art.

Such a device is attained according to the invention having the features described below.

The use of a hinge permits the carrier to be moved away from its position without it having to be removed.

The use of two holding elements provides that the carrier can be arranged with its ends at both sides on the furniture carcass.

That affords the advantage of easy mounting as firstly the holding element can be mounted to the furniture carcass and it is only then that the carrier can be mounted with the functional unit to that holding element.

Equally the pivotability of the carrier makes it easier to implement subsequent replacement of the functional unit insofar as the carrier can be pivoted and/or released from the holding element in a simple fashion or if access to the region behind the carrier is wanted, it can be moved away—as it is arranged pivotably on the holding element—without it having to be removed for that purpose.

Further advantageous configurations of the invention are defined in the appendant claims.

It has proven to be particularly advantageous if the carrier can be connected to the holding element without a tool. Mounting the carrier to the holding element without a tool permits rapid assembly.

In a preferred embodiment it can be provided that the holding element has a base portion for receiving the carrier and a—preferably pivotable—lock member for positionally securely holding the carrier in or to the base portion.

The use of a lock member can ensure that the carrier can be arrestably mounted to the holding element.

Particularly preferably it can be provided that a locking device is arranged in the free end, opposite the hinge, of the carrier. The use of a locking device makes it possible to provide that the carrier is not moved away from its predetermined position.

In that respect it has proven to be particularly advantageous if the device has an elastic or spring-loaded latch on the holding element or the carrier. The use of a latch makes it possible to achieve an inexpensive possible way of connecting the holding element to the carrier.

In a preferred embodiment it can be provided that the latch is formed in one piece as a projection on the holding element or the carrier. No additional mounting times are required due to the latch being of an integral nature on the holding element or on the carrier.

It has further proven to be advantageous if the latch on the holding element or the carrier latches into a groove on the carrier or the holding element. A groove is particularly well suited for accommodating a latch therein and thus arranging the carrier or the holding element in positionally secure relationship. It has proven to be advantageous if the device for releasably connecting the carrier to the holding elements has two locking devices, wherein they are provided on the carrier and/or the holding elements. The use of two locking devices at the ends of the carrier thus makes it possible to provide that the carrier is retained securely in position on the furniture carcass.

Preferably it can further be provided that the holding element and/or the carrier have a U-shaped profile. U-shaped profiles increase the stability of the carrier or the holding element respectively.

In a possible embodiment it can be provided that the carrier is in the form of a horizontally lying profile bar—preferably of metal or plastic.

In a preferred embodiment it can be provided that the holding element and/or the locking device are made from metal or plastic.

It has also proven to be advantageous if the functional unit is a motor-driven ejector for drawers and/or the functional unit is in the form of a lighting unit.

In an embodiment of the invention the functional unit is arranged releasably on the carrier, preferably without a tool. That gives the advantage that the functional unit can be replaced without it having to be removed from the carrier in that case.

In that respect it has proven to be particularly advantageous if the functional unit is arranged substantially centrally on the carrier. In that way it is for example possible for a drawer to be moved out substantially without jamming by the ejector of a drive unit if that ejector is disposed substantially in the center of the carrier.

Protection is also claimed for an article of furniture comprising a device for fastening a functional unit in a furniture carcass according to the described embodiments.

Further details and advantages of the present invention will be described more fully hereinafter by means of the specific description with reference to the embodiments illustrated in the drawing in which:

DETAILED DESCRIPTION OF THE INVENTION

Figure 1:
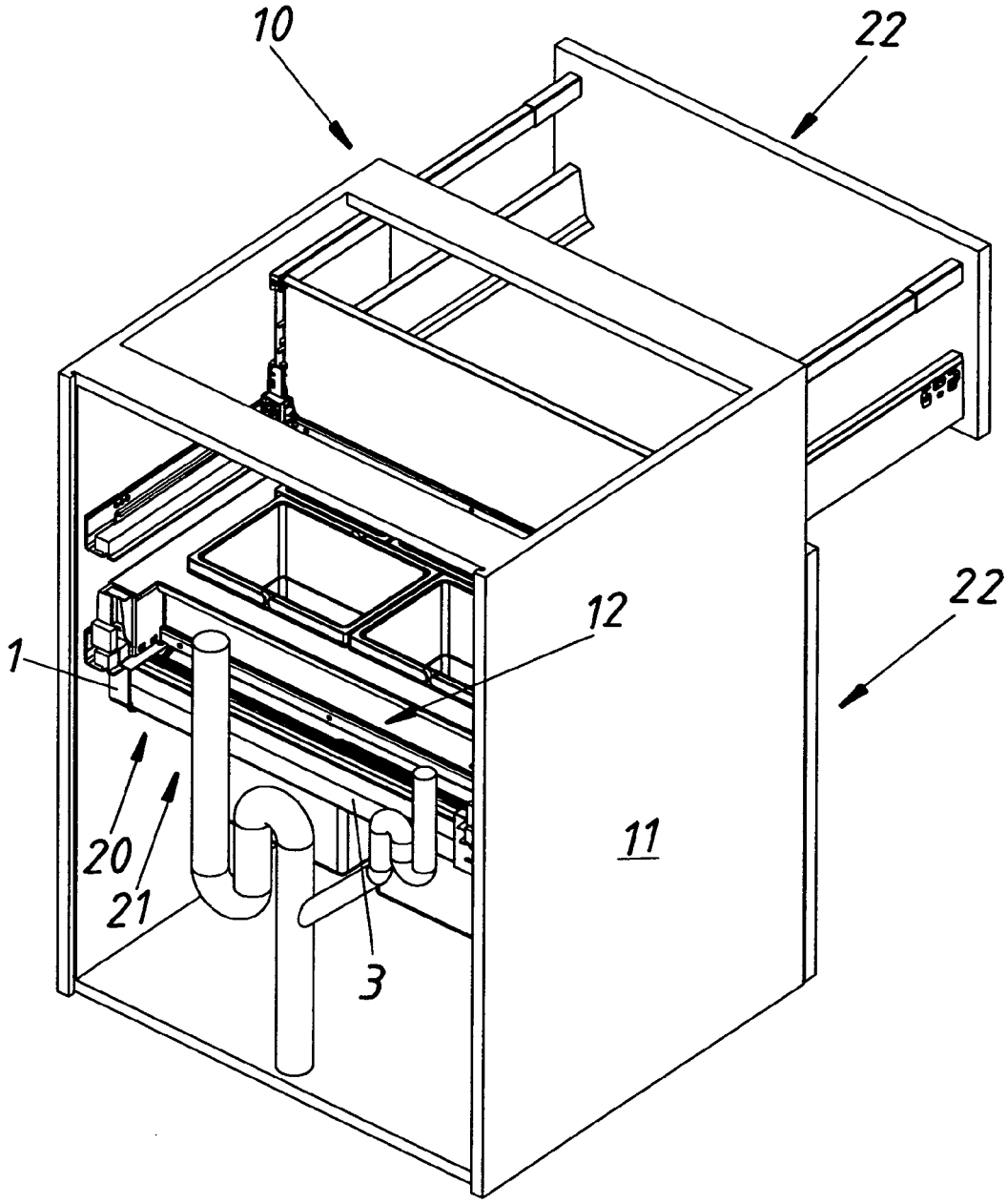
FIG. 1 shows a perspective rear view of an article of furniture with a transverse carrier arranged therein.

FIG. 1 shows a perspective rear view of an article of furniture 10. The article of furniture 10 has a furniture carcass 11 with drawers 22 arranged therein. In this case the lower drawer 22 is drivable by a functional unit 12 (not visible). That functional unit 12 is in turn mounted on the transverse carrier 21—which is arranged transversely in the furniture carcass 11. The transverse carrier 21 has the device 20 for fastening the functional unit in the furniture carcass 11, in that case the device 20 comprises the holding element 1 mounted to the furniture carcass 11 and the carrier 3 in the form of a horizontally disposed profile bar.

Figure 2A:
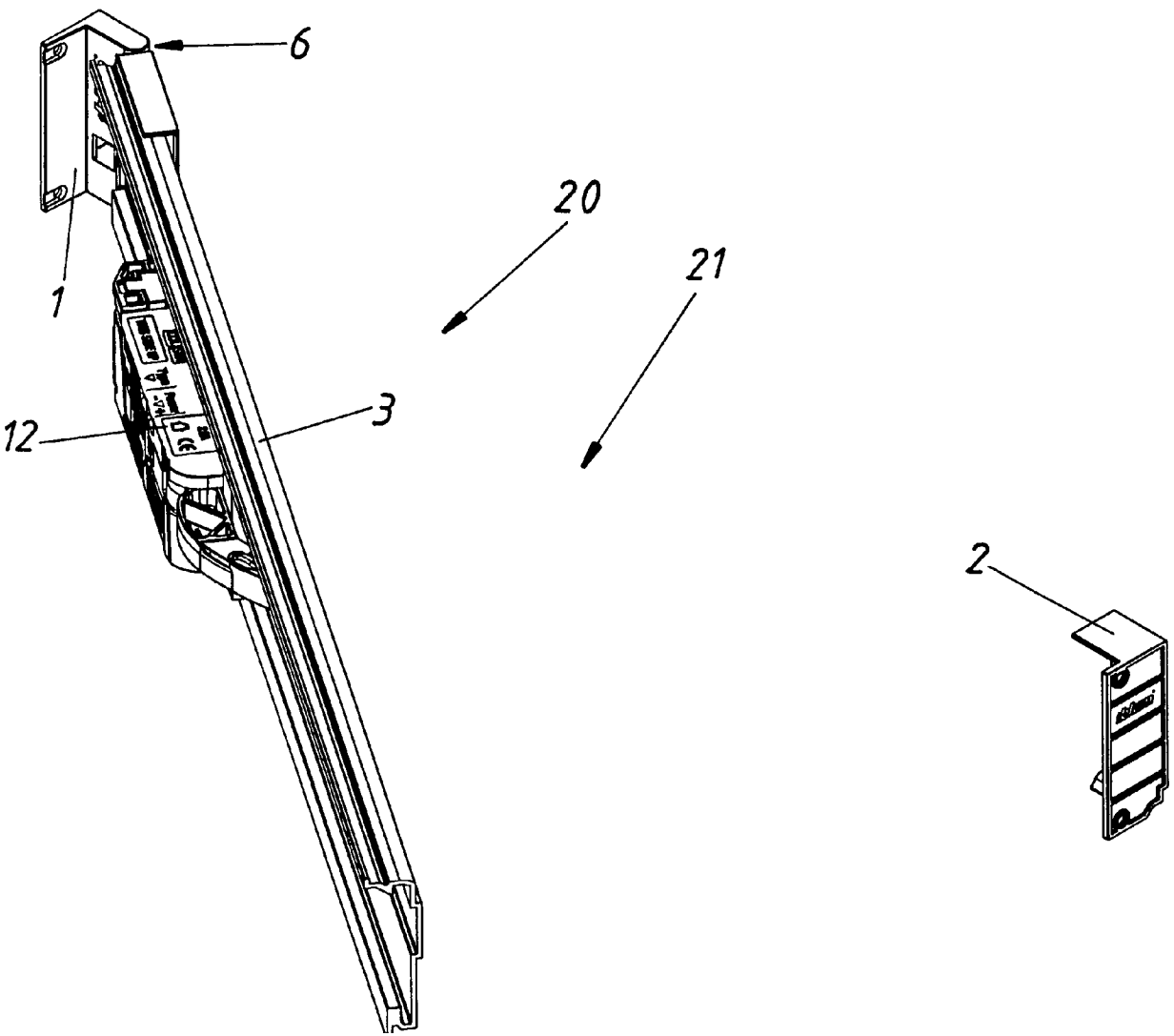
FIG. 2*a* shows a perspective view of a device for fastening a functional unit in a furniture carcass in the opened condition.

FIG. 2*a* shows a perspective view of a device 20 for fastening a functional unit 12 in a furniture carcass 11, wherein the functional unit 12 is pre-mounted to the carrier 3. In this case the carrier 3 is mounted movably to the holding element 1. The holding elements 1 and 2 in turn are fastened to the furniture carcass 11 (not shown). An opened position is shown here, in which the carrier 3 can be moved pivotably closer to the holding element 2—by means of the pivotal hinge 6.

Upon first mounting thereof the carrier 3 is preferably introduced into the hinge 6 of the holding element 1, preferably being clipped thereinto, and is thus pivotably connected thereto. It will be appreciated that as a further consequence it can also be released therefrom again.

Both the carrier 3 and also the holding element 2 have a U-shaped profile.

The carrier 3 can be arranged horizontally in the furniture carcass 11 in the form of a lying profile bar on the holding elements 1, 2, in that respect metal or plastic is used as the preferred material for the carrier 3 and for the holding elements 1, 2.

In this embodiment the functional unit 12 is in the form of a motor-driven ejector for drawers. Such a drawer drive is already known from the state of the art (see WO 2008/098267 A1).

It will be appreciated that this functional unit 12 can also be in the form of a lighting unit.

Figure 2B:
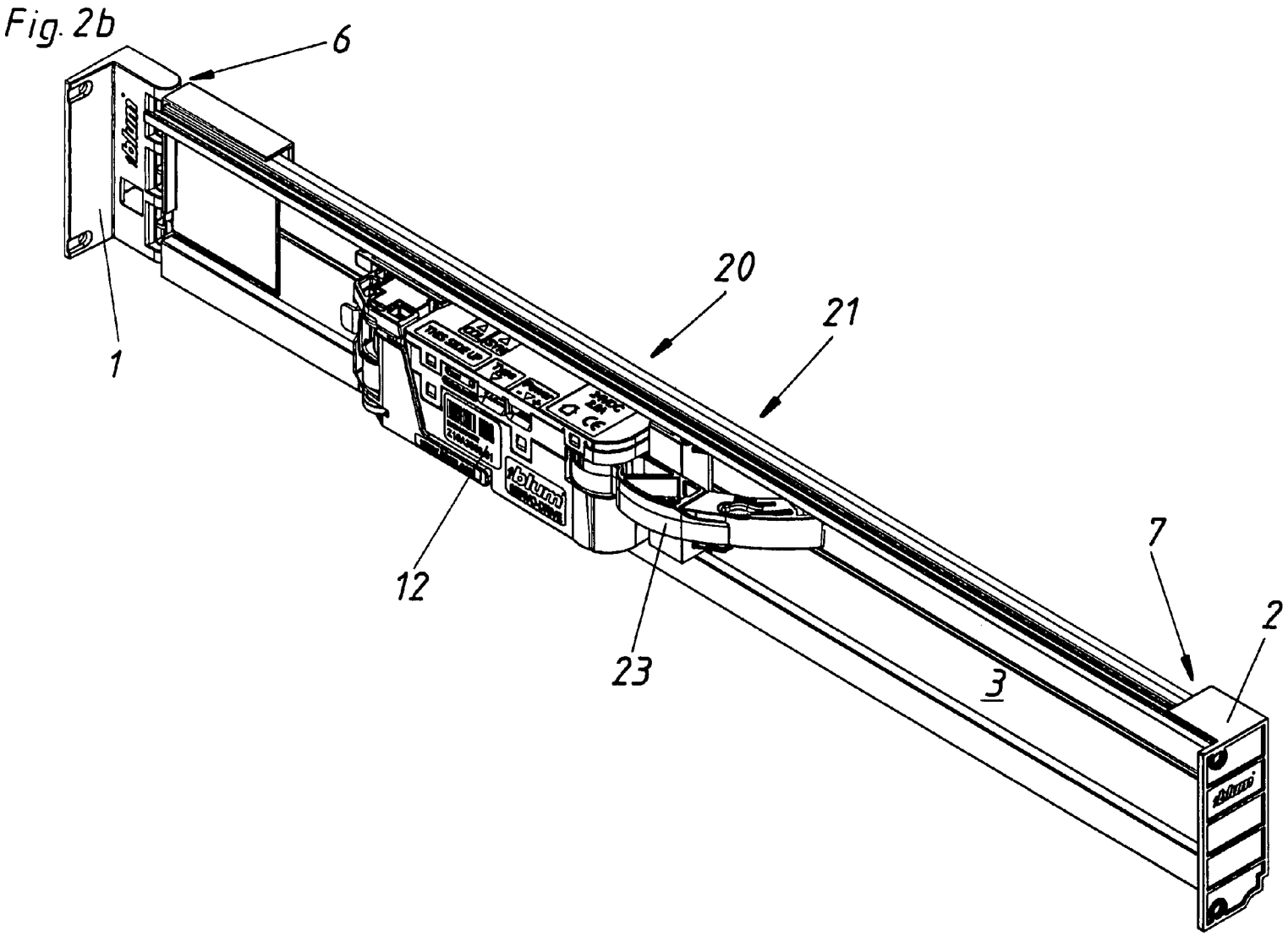
FIG. 2*b* shows a perspective view of a device for fastening a functional unit in a furniture carcass in the closed condition.

FIG. 2*b* shows the transverse carrier 21 in the closed condition. The device 20 for fixing a functional unit 12 in the furniture carcass 11 (not shown) is disposed in the position in which the carrier 3 is latched with its free end in the locking device 7 of the holding element 2. That is made possible by pivotal movement of the carrier 3 by way of the hinge 6 of the holding element 1. The functional unit 12—in this embodiment in the form of a furniture drive—is in that case arranged releasably on the carrier 3, without the use of a tool.

To permit preferred ejection of a drawer 22 (not shown) the functional unit 12 is in this case so positioned that its ejector 23 is arranged approximately in the center of the carrier 3.

That pivotable arrangement of a carrier 3 on the holding element 1 means that it is easily possible for the assembly personnel to reach the space behind the carrier 3 without in that case having to remove the transverse carrier 21 or the functional unit 12 or its carrier 3.

Figure 3A:
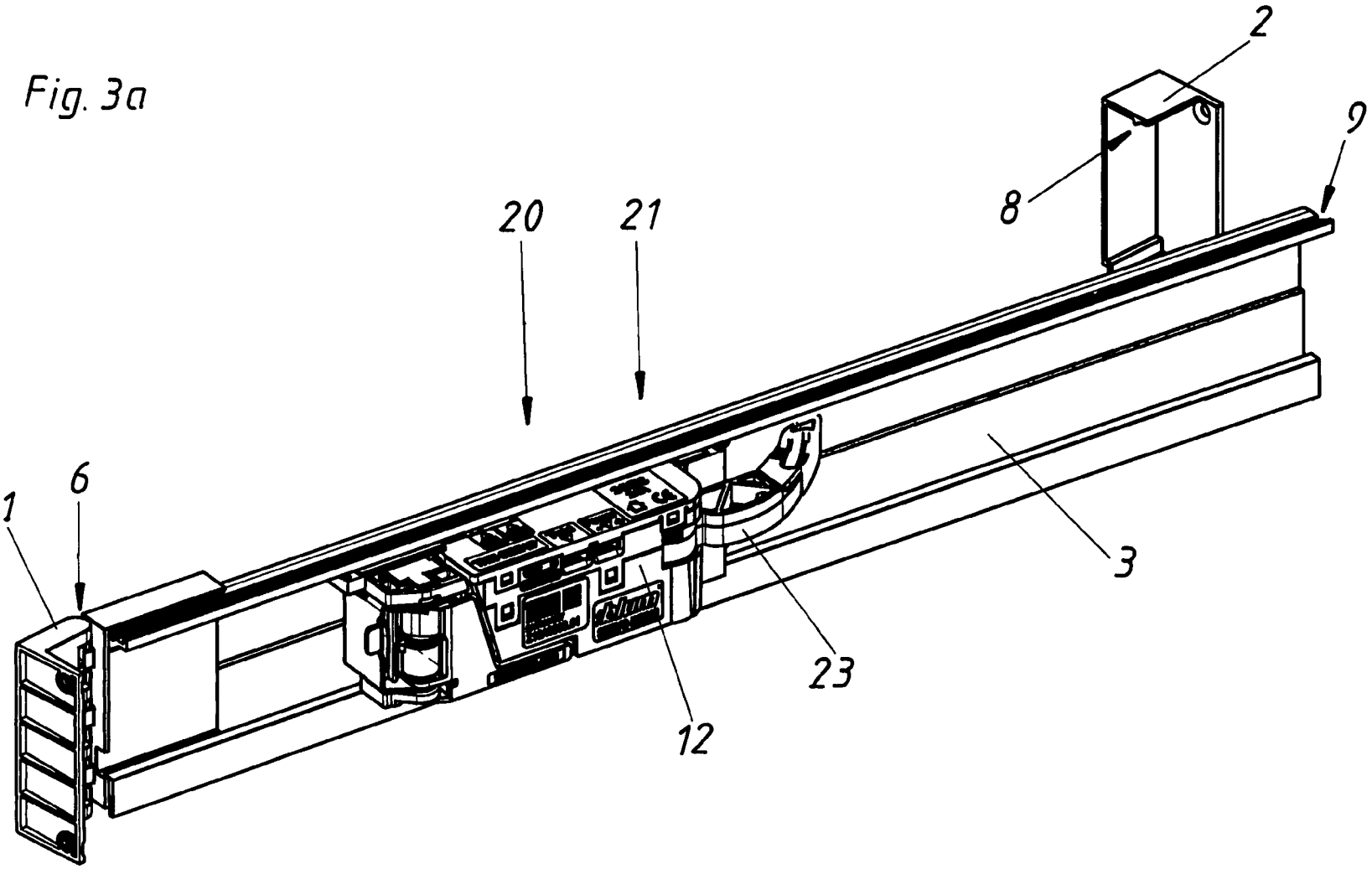
FIG. 3*a* shows a further perspective view as in FIG. 2*a*.

FIG. 3*a* shows a further perspective view of the transverse carrier 21 already described with reference to FIGS. 2*a* and 2*b* or the device 20. Here it is possible to see on the holding element 2 the elastic latch 8 and the groove 9 of the carrier 3, the groove corresponding to the latch 8 and also being elastic.

In this case the latch 8 is formed integrally as a projection on the holding element 2, it will be appreciated that it could also be formed integrally as a projection on the carrier 3.

Preferably both the holding elements 1 and 2, the locking device 7 and also the carrier 8 comprise metal or plastic.

Figure 3B:
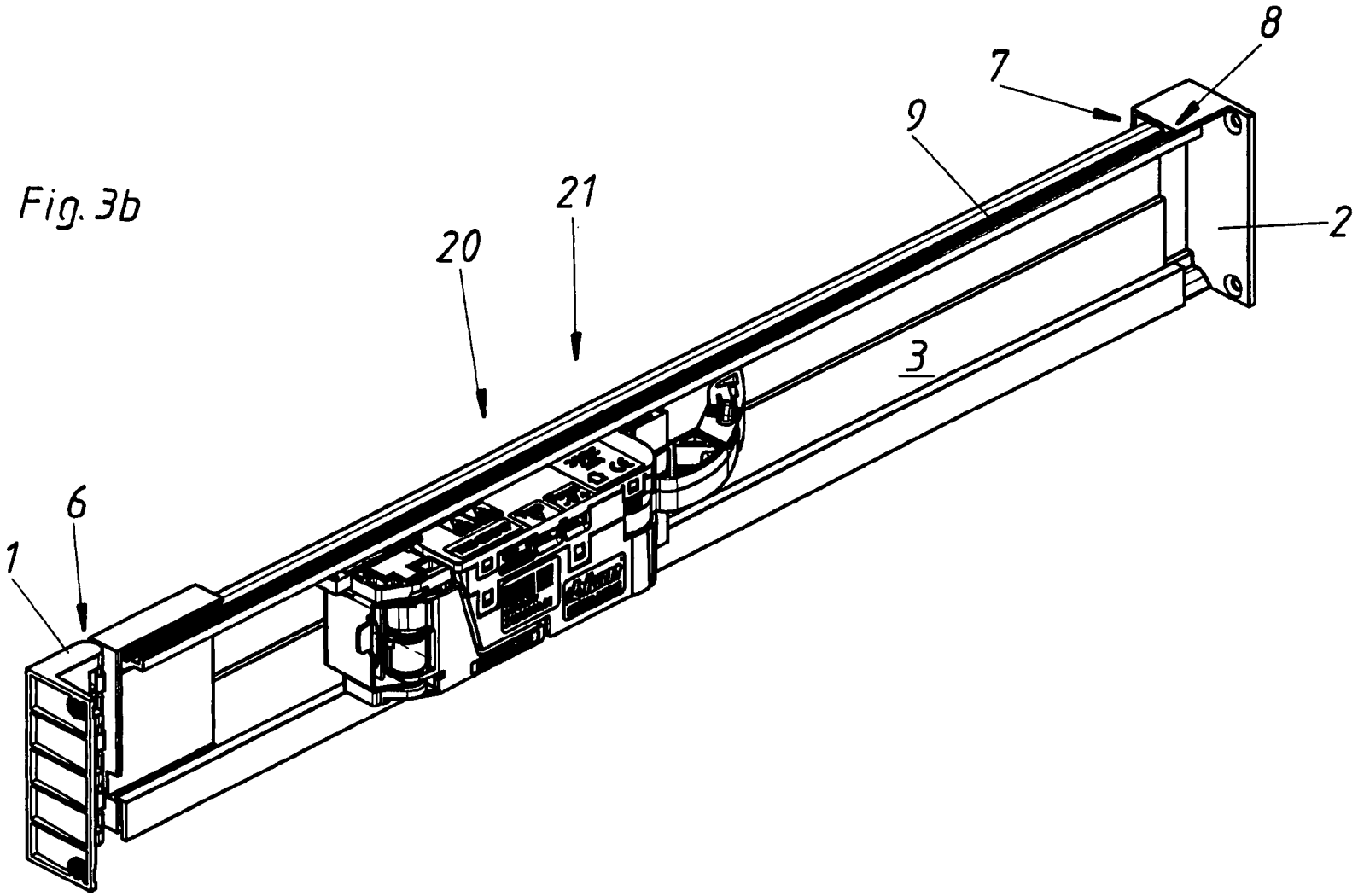
FIG. 3*b* shows a further perspective view as in FIG. 2*b*.

In the closed condition as can be seen from FIG. 3*b* the locking device 7 comes into operation insofar as the latch 8 of the holding element 2 latches into the groove 9 of the carrier 3. It will be appreciated that the groove 9 could equally be provided on the holding element 2 and the latch 8 on the carrier 3. The U-shaped profile of the carrier 3 and the U-shaped profile of the holding element 2 are very clearly visible from FIGS. 3*a* and 3*b*. That contributes to the stability of those two elements.

Figure 4A:
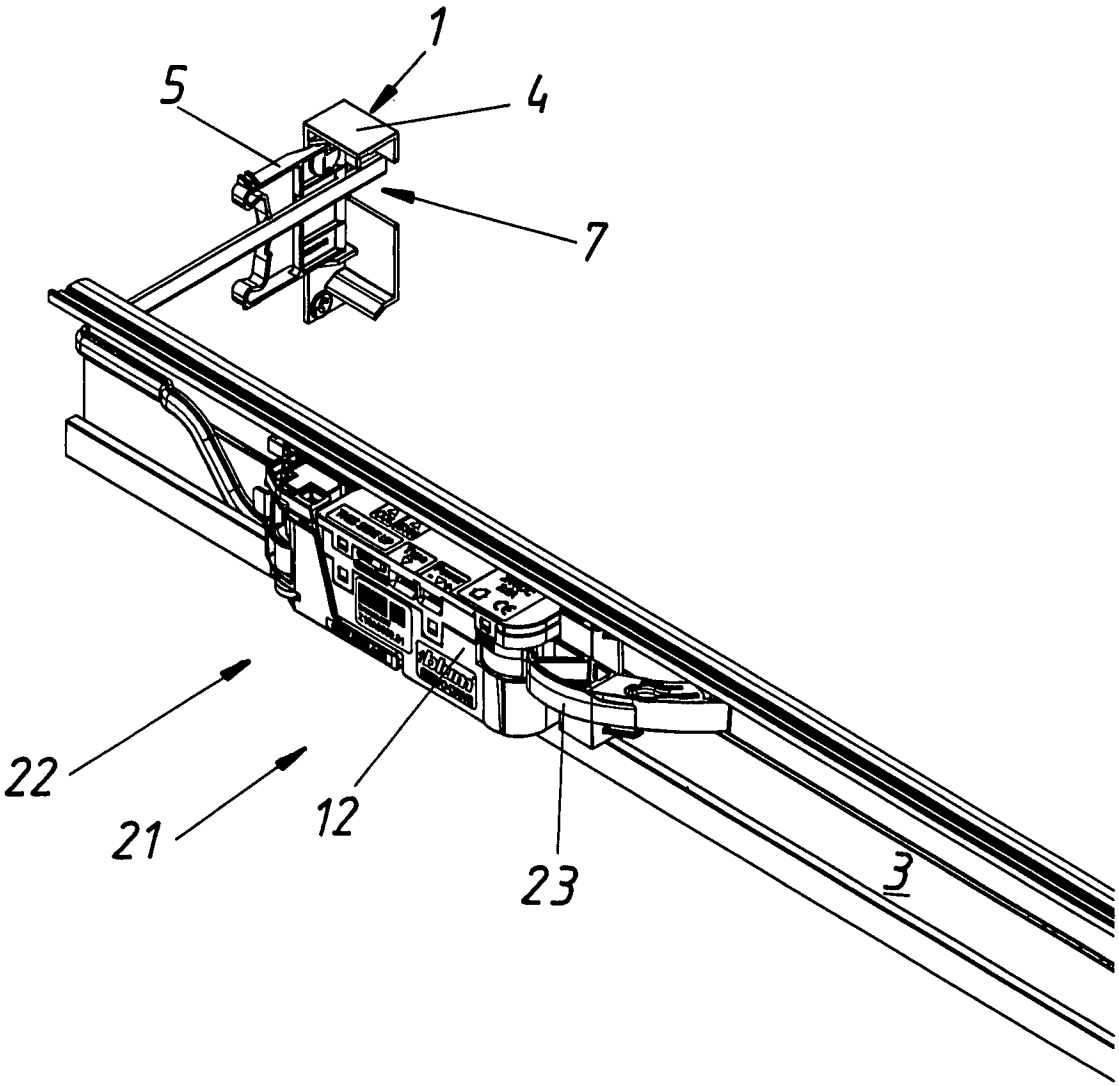
FIG. 4*a* shows a perspective view of a device for fastening a functional unit in a furniture carcass in the released condition.
Figure 4B:
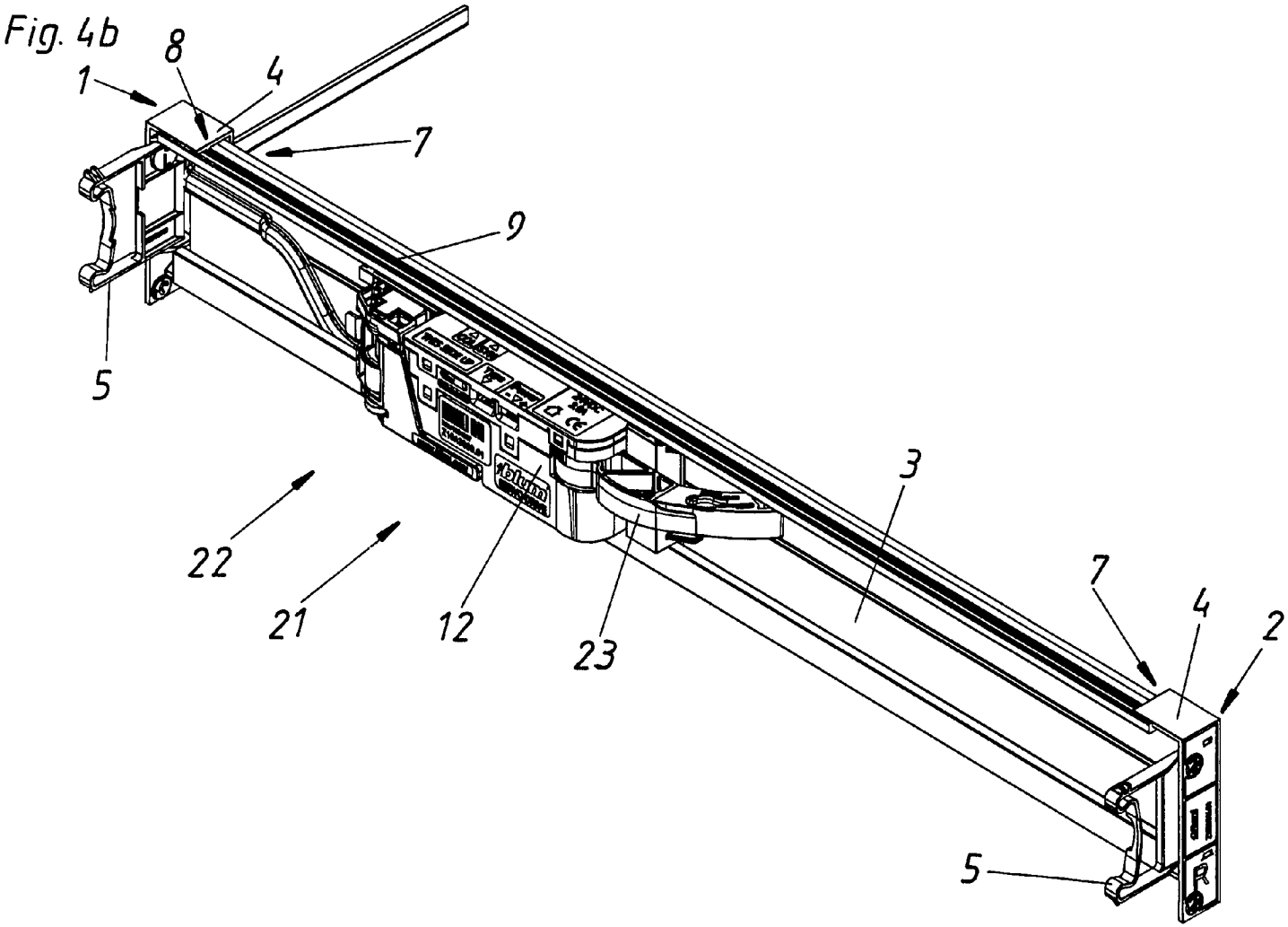
FIG. 4*b* shows a perspective view of a device for fastening a functional unit in a furniture carcass in the connected but unlocked condition.
Figure 4C:
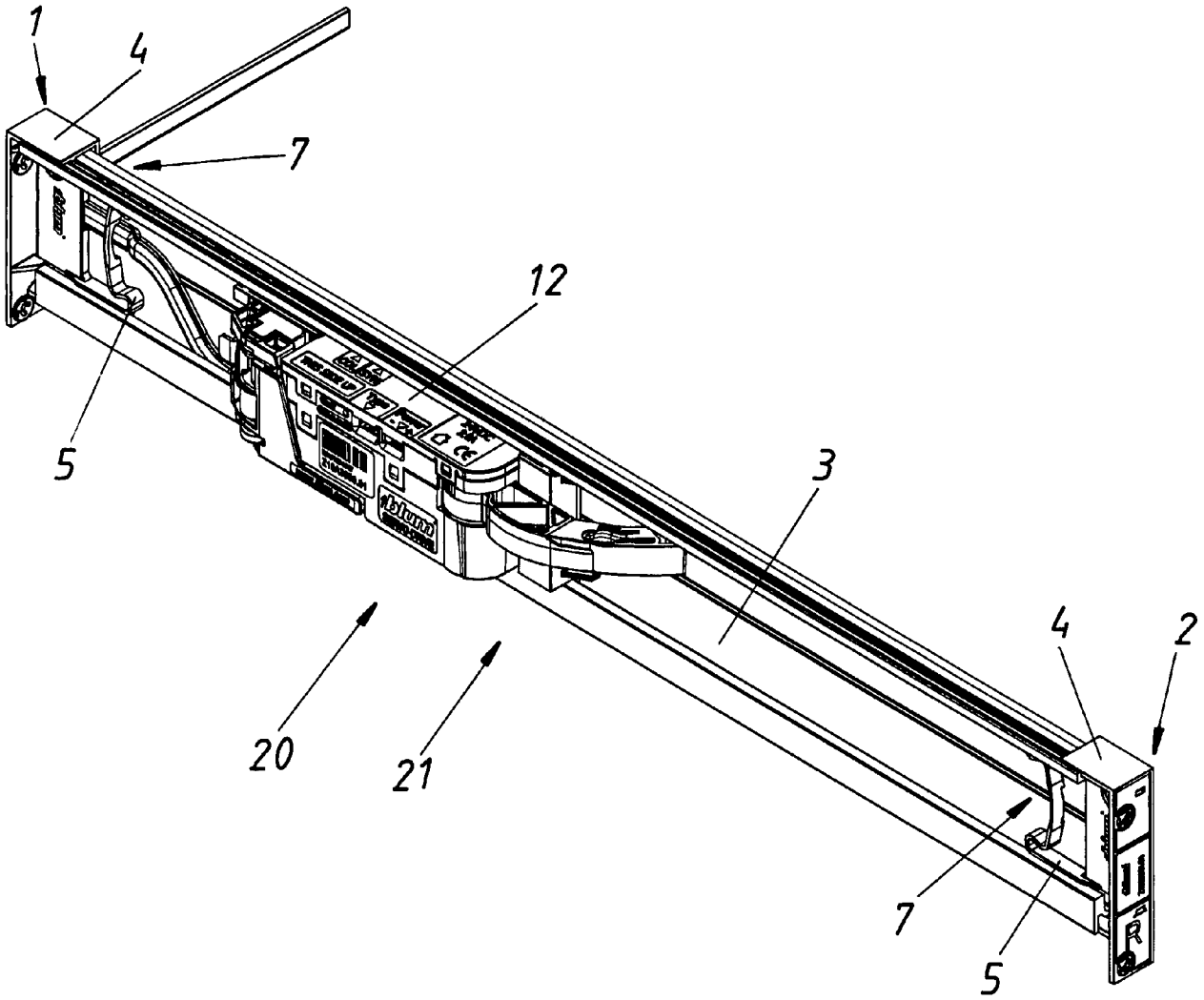
FIG. 4*c* shows a device for fastening a functional unit in a furniture carcass in the connected and locked condition.

FIGS. 4*a* through 4*c* now show a variant of the device 20 for fastening a functional unit 12 in a furniture carcass 11 (not shown).

FIG. 4*a* shows a carrier 3 which is separate from the holding element 1 and which is in the form of a horizontally disposed profile bar. As already mentioned in the foregoing specific description the functional unit 12 is disposed on the carrier 3. The carrier 3 can be releasably fastened to the holding element 1.

The holding element 1 has a base portion 4 for receiving the carrier 3 and a pivotable lock member 5 for holding the carrier 3 securely in position in or on the base portion 4.

Both the holding element 1 and also the carrier 3 have a U-shaped profile to enhance the stability of those components.

In FIG. 4*b* the carrier 3 is fitted into the two holding elements 1 and 2 and latched in the groove 9 of the carrier 3 by way of the latching projections 8 of the holding elements 1 and 2.

In this embodiment the locking devices 7 are not yet active as the lock members 5 are not closed in the two holding elements 1 and 2 (see in that respect FIG. 4*c*).

In this embodiment also the carrier 3 can be connected to the holding elements 1 and 2 without a tool.

Preferably metal or plastic is used as the material for the holding elements 1 and 2 and the locking devices 7 as well as the carrier 3.

FIG. 4*c* shows the device 20 in the closed condition, wherein the lock members 5 of the holding elements 1, 2 have been pivoted in the direction of the carrier 3 and thus result in the carrier 3 being held securely in position in the base portions 4 of the holding elements 1 and 2.

Thus the ends of the carrier 3 are held by the two holding elements 1 and 2 of the device 20.

Even if the invention has been described in specific terms by means of the illustrated embodiment it will be appreciated that the subject-matter of the application is not restricted to that embodiment. Rather it will be self-evident that measures and modifications which serve to carry the inventive concept into effect are certainly conceivable and desired.

The invention claimed is:

1. An apparatus comprising:

a motor-driven ejector for drawers; and a device for fastening the motor-driven ejector in a furniture carcass, the device comprising a carrier and two holding elements, wherein the motor-driven ejector is pre-mounted to the carrier, and the two holding elements are to be mounted to opposing surfaces of the furniture carcass, respectively, wherein opposite ends of the carrier are fixed to the holding elements, respectively, and wherein one of the holding elements is in the form of a hinge, and one of the ends of the carrier is pivotably connected to the hinge.

2. The apparatus according to claim 1, wherein the carrier is elongate and the holding elements hold the elongate carrier at the ends.

3. The apparatus according to claim 1, wherein the carrier can be connected to the holding elements without a tool.

4. The apparatus according to claim 1, wherein each holding element has a base portion for receiving the carrier and a lock member for positionally securely holding the carrier in or to the base portion.

5. The apparatus according to claim 4, wherein the lock member is pivotable.

6. The apparatus according to claim 1, wherein a locking device is arranged in the holding element which is opposite the hinge.

7. The apparatus according to claim 6, wherein at least one of the locking device and the holding elements is made from metal or plastic.

8. The apparatus according to claim 6, wherein the other of the ends of the carrier is engaged with the locking device such that the carrier is not moved from a predetermined position.

9. The apparatus according to claim 1, wherein the device has an elastic or spring-loaded latch on the carrier or one of the holding elements.

10. The apparatus according to claim 9, wherein the latch is formed in one piece as a projection on the carrier or the one of the holding elements.

11. The apparatus according to claim 9, wherein the latch on the carrier or the one of the holding elements latches into a groove on the other of the carrier and the one of holding elements.

12. The apparatus according to claim 1, wherein the carrier is releasably connected to the holding elements, and wherein the device has two locking devices, the locking devices being provided on at least one of the carrier and the holding elements.

13. The apparatus according to claim 1, wherein at least one of the carrier and the holding elements has a U-shaped profile.

14. The apparatus according to claim 1, wherein the carrier is in the form of a horizontally lying profile bar.

15. The apparatus according to claim 1, wherein the carrier is in the form of a horizontally lying profile bar of metal or plastic.

16. The apparatus according to claim 1, wherein at least one of the holding elements is made from metal or plastic.

17. The apparatus according to claim 1, wherein the motor-driven ejector is arranged releasably on the carrier.

18. The apparatus according to claim 17, wherein the motor-driven ejector is arranged so as to be releasable from the carrier without a tool.

19. The apparatus according to claim 1, wherein the motor-driven ejector is arranged substantially centrally on the carrier.

20. An article of furniture comprising:

a furniture carcass; and the apparatus according to claim 1, wherein the motor-driven ejector is fastened in the furniture carcass via the apparatus.

21. The apparatus according to claim 1, wherein the carrier is a single horizontally lying profile bar.

* * * * *